United States Patent [19]

Marchesi

[11] 4,284,019

[45] Aug. 18, 1981

[54] LUBRICANT SEALING DEVICE FOR SEWING MACHINES

[76] Inventor: Franco Marchesi, Via S. Giovanni Bosco 17, Pavia, Italy

[21] Appl. No.: 171,879

[22] Filed: Jul. 24, 1980

[30] Foreign Application Priority Data

Sep. 7, 1979 [IT] Italy ..... 25529 A/79

[51] Int. Cl.[3] ..... D05B 71/00

[52] U.S. Cl. ..... 112/256; 277/177

[58] Field of Search ..... 112/256, 323, 324; 184/6.14, 5, 100; 308/3.5; 277/174, 177

[56] References Cited

U.S. PATENT DOCUMENTS 3,418,955 12/1968 Attwood et al. ..... 112/256

3,785,310 1/1974 Marforio ..... 112/256

4,075,960 2/1978 Klundt ..... 112/256

*Primary Examiner*—H. Hampton Hunter

[57] ABSTRACT

A lubricant sealing element for the slide members which actuate the feed dogs in a sewing machine fabricated from a resilient wear resistant material and having lubricant scraping surfaces formed by spaced walls defining an opening conforming in size to the cross-sectional configuration of the slide members and through which the latter extend. The sealing element is mounted for sliding movement restricted to the alternate vertical movement of the slide members and the spaced walls are of a thickness approximately one third the thickness of the remainder of said element which permits them to yield first in one direction and then the other with the alternate horizontal movement of the slide members.

10 Claims, 6 Drawing Figures

LUBRICANT SEALING DEVICE FOR SEWING MACHINES

BACKGROUND OF THE INVENTION

The present invention pertains to a lubricant sealing device for the feed dog actuating slide members (hereinafter referred to as slide members) in a sewing machine. The device defines a plate-shaped element having a suitable opening through which one or more actuating slide members are adapted to extent. The shaped element is slidable supported by a pair of spaced and vertically extending guides which are mounted in a flanged support bracket having a cross-sectional configuration that is generally U-shaped. This support bracket includes a longitudinal channel that serves to guide the slide members during the performance of their intended functions and by means of its flanged portion, it is mounted in the framework of the machine in a manner which separates those elements requiring lubricant from those which do not.

It is well known that in certain types of sewing machines the driving mechanisms and associated seats subject to wear require adequate lubrication which makes it necessary to maintain a definite separation between the areas in which the elements being lubricated are operating and the area of the stitching zone so as to prevent migration of lubricant to the stitching instrumentalities which as can be readily understood would be the cause of a very undesirable condition of soiling the workpieces as they are being sewn. It is common practice to provide the casing of the machine with a chamber within which the mechanisms for effecting actuation of the feed dogs are mounted.

As is well known, the feed dogs are located in the sewing zone which is spaced from the chamber and they are supported by slide members which extend from and through a suitable opening provided in one wall of said chamber which defines a surface separating the latter from the area which should be devoid of lubricant. To prevent the lubricant from escaping from the chamber in the area providing clearance for the slide members extending through the opening in the chamber wall, known forms of sealing devices are utilized which have a configuration conforming to the cross-sectional configuration of one or more slide members. Having this configuration, the sealing devices closely surround the slide members and serve as oil scraping elements during operation of said slide members.

The known types of sealing elements have a serious disadvantage of requiring frequent replacement due to wear and are considered to have an undesirable life expectancy. Wear is attributed to the frictional contact of the slide with the walls of the sealing device that define the opening through which said slide extends. Although the thickness of the known type of sealing elements is on the order of 1–2 millimeters as well as the material utilized in their fabrication having a low coefficient of friction, such as Teflon and the fact that the walls defining the opening are fabricated to conform to the cross-sectional configuration of the slide, they soon become worn due to the frictional forces to which they are subjected thus causing them to become curved in the direction of their outer edges, as well as to the rounding off of their edges whereby they are rendered ineffective in operation as oil scraping devices.

To correct this serious disadvantage, an object of the present invention is that of providing a sealing device for the lubricant in which the plate-shaped sealing element possesses characteristics which will provide an improved combination lubricant seal and an oil scraper that will have a substantially greater life expectancy than the known forms of sealing devices.

SUMMARY OF THE INVENTION

To accomplish this object, the plate-shaped sealing element has an opening through which one or more slide members extend and the sides of said opening define walls having a thickness which is reduced to approximately one-third of the thickness of the remainder of the sealing element itself. This reduction in thickness of the walls substantially reduces the damaging effects thereto by the continuous rubbing action to which they are subjected by the slide members.

This characteristic provides the advantage of practically eliminating the resultant curvature of the walls by the slide members, as was a common problem with known sealing elements, for when utilizing surfaces of such reduced size, which are on the order of 2–4 tenths of a millimeter, any possible rounding off of the outer edges is still acceptable and does not change their oil scraping effectiveness that is in the form of a film on the exterior surfaces of said slide members.

A further characteristic of the lubricant sealing device is the surfaces which interconnect the body portion thereof with the walls of decreased thickness that define the opening through which the slide members extend. These surfaces are tapered so as to be directed away from the walls and in a direction which extends outwardly from the interior of the chamber that houses the various elements requiring lubrication. These tapered surfaces serve as a means for directing excess lubricant removed from the slide members by the walls of the opening in a downwardly direction and the combination prevents the migration of the lubricant along the length of said slide members and to areas that are required to be maintained free of lubrication.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
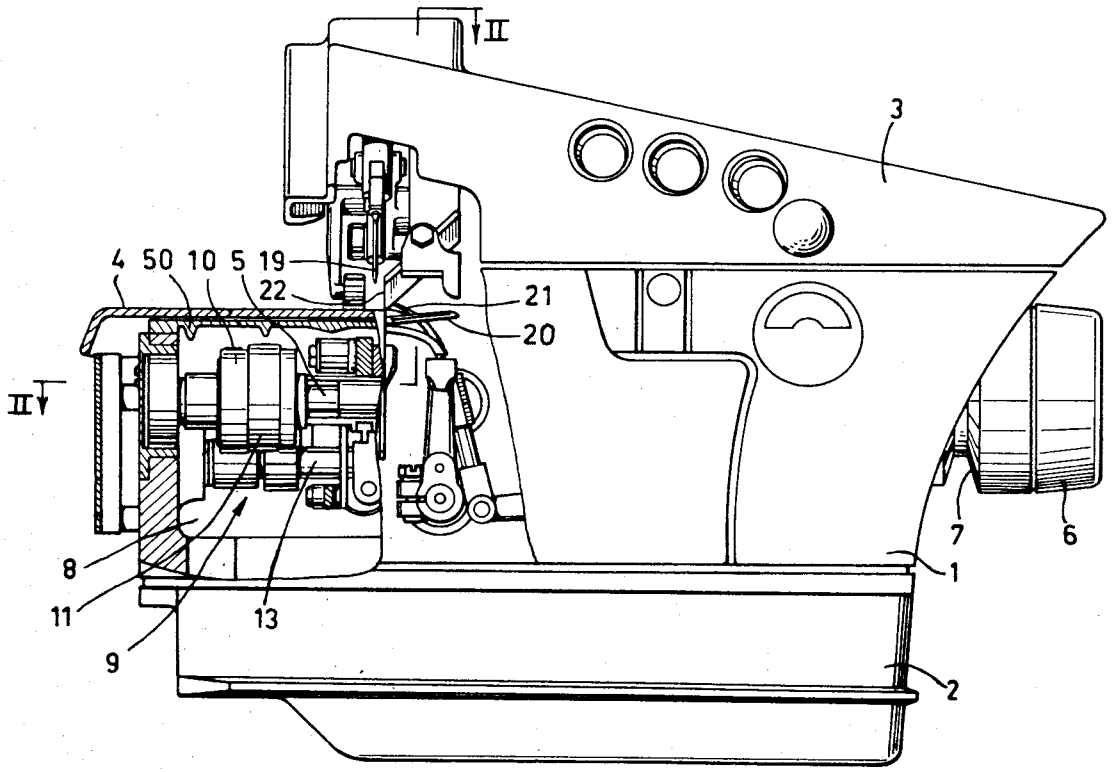
FIG. 1 is a view in front elevation and partially in section of a sewing machine to which the invention is applicable.

The lubricant sealing device of the present invention has been illustrated applied to an industrial sewing machine of the whipstitch type. With reference to FIG. 1, the sewing machine is provided with a housing or casing having a base portion 1, a lubricant reservoir identified by numeral 2, a support column 3 extending upwardly from the base 1, and a worksurface 4 for supporting a workpiece during the seaming operation.

As is well known, the casing houses all the various mechanisms necessary for operation of the sewing machine. A main shaft 5 is supported within the base 1 and extending outwardly beyond one end thereof its outer end has a handwheel 6 fixed thereon and immediately adjacent the latter, a grooved pulley 7 is fixed on said main shaft which serves to interconnect the machine with any suitable source of drive (not shown). The opposite end of the main shaft 5 terminates within a chamber 8 and serves to support the well known elements for actuating the machine's feed dogs which includes an eccentric member 10, a connecting rod 11 (FIG. 2) which operatively interconnects said shaft 5 with an arm 12 that is operatively connected to an oscillatably drive shaft 13. This oscillatably driven shaft 13 has a second arm 14 assembled thereon and is operatively connected, by means of a connecting rod 15, to a slide member 16. The free end of this slide member 16 has a feed dog 17 mounted thereon that is conventionally located in the sewing zone externally of the casing and which is separated from the chamber 8 by means of a dividing wall 18. The sewing zone includes the usual stitching needle 19 which cooperates during its intended function with conventional loopers 20 and 21 that are located beneath the worksurface 4, all of which is well known to those conversant in the art. A presser foot identified by numeral 22 is also located in the sewing zone and cooperates with the feed dogs to effect advance of a workpiece during the sewing operation. A conventional needle plate 23 is mounted on the worksurface 4 in the sewing zone and in operative association with the presser foot 22 and feed dogs 17.

Figure 2:
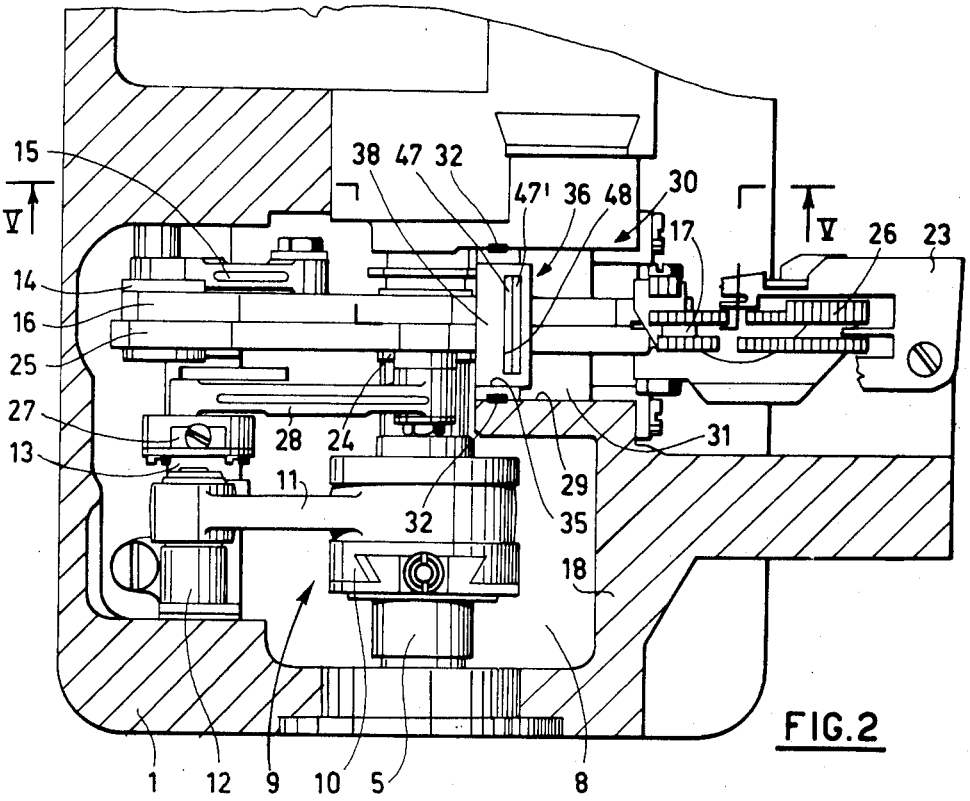
FIG. 2 is a sectional view of the sewing machine as seen looking in the direction of the indicating arrows of Line II—II in FIG. 1.

The mechanism for actuating the feed dogs is depicted generally in FIGS. 1 and 2 by numeral 9 and provides a means for effecting a combined horizontal and vertical movement of the slide member 16 which in effect results in the feed dog 17 carried by said slide member to travel in a generally elliptical pathway. This elliptical pathway causes the feed dog 17 to first rise and protrude through the needle plate 23, then move rearwardly to advance the workpiece after which it is lowered and moved forwardly to repeat the cycle as is also well known.

The type of sewing machine to which the present invention is applicable may also be provided with a differential workpiece advancing apparatus in which case a second slide member 25 is provided that is located in side by side relationship with slide member 16 and it carries a second feed dog 26 in general alignment with the feed dog 17. The second slide member 25 is driven by means of a connecting rod 28 which operatively connects it with an arm 27 carried on the oscillatably driven shaft 13. The structure of the differential workpiece advancing apparatus and details of its operation will not be described in further detail for it is not considered essential for a complete understanding of the invention. Sewing machines of the type to which the invention is applicable generally operate at high speeds which is on the order of 6,000–8,000 revolutions per minute, and the various mechanisms for initiating actuation of the various moving elements of the machine must be adequately lubricated. The chamber 8 holds a sufficient amount of lubricant for this purpose and to prevent loss of lubricant through the opening 29 provided for one or more slide members, a sealing device generally identified by numeral 30 is provided which is assembled in said opening in a manner to be more fully described hereinafter.

Figure 3:
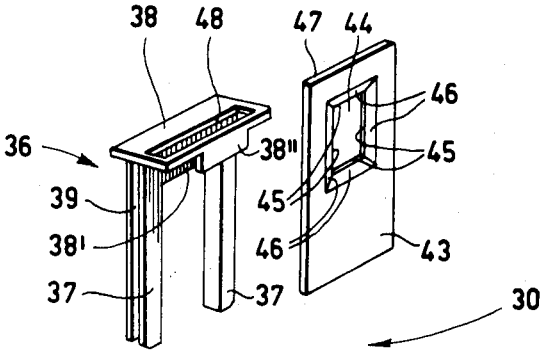
FIG. 3 is a perspective view in exploded form showing the lubricant sealing device according to the invention and its means for support in the sewing machine.

Referring now to FIG. 3, this sealing device includes among its plurality of parts, a generally U-shaped flanged support bracket 31 having an outer configuration which conforms to the shape of the opening 29 and by means of a gasket 32 assembled in a seat 33 formed on the outer surface of said support bracket, the latter is assembled in said opening 29. This support bracket 31 is provided with a centrally disposed and longitudinally extending channel 34 which serves as a guide for the slide members 16 and 25. The width of this channel 34 will vary depending on the type of workpiece advancing apparatus that is utilized, or in other words, it is of a selected width that is appropriate for the number of slide members utilized. In its assembled position the end of the support bracket 31 communicating with the chamber 8 is provided with a recess 35 having a width slightly greater than, and a depth which causes it to communicate with the channel 34. This recess 35 serves to house a support member generally identified in FIG. 3 by numeral 36 which includes a horizontal cross-piece 38 and a pair of spaced leg members 37 depending therefrom. Each of these leg members 37 is provided on its outer and opposed surface with a longitudinal groove 39 (one only shown in FIG. 3) into which the sides of a pair of spaced plate members 40 are adapted to extend so as to fix the position of the support member 36 in the recess 35. These plate members 40 are attached to the inner surface of the recess 35 by means of screws 41 and positioning pins 42.

This recess 35 has a longitudinal depth which is sufficient to position at least one plate-shaped sealing element 43 in close proximity with the inner end of the channel 34. This sealing element 43 is fabricated from a wear-resisting resilient material, such as Telfon or a suitable type of synthetic rubber. The plate-shaped element 43 has a rectangular configuration and is provided with an opening 44 through which at least one slide member extends. This opening 44 has a shape which conforms to the cross-sectional configuration of either one or the combination of the number of slide members being utilized. The opening 44 is defined by opposed walls 45 having a thickness of approximately one-third of the body portion of the plate-shaped sealing element 43.

As shown in FIG. 3, the surfaces which interconnect the opposed walls 45 with the body portion of the sealing element 43 are inclined or tapered so as to diverge from the opening 44 and are identified by numeral 46. The combination of these inclined surfaces 46, the reduced thickness of walls 45, and the elasticity of the material from which the sealing element 43 is fabricated permits said walls 45 to flex or yield first in one direction and then the other during actuation of the slide members thereby substantially reducing the damaging effects of wear to said walls 45.

The inclined surfaces 46 may be formed in a variety of ways, that is to say they can be concave, in the form of an inclined plane, depressed in the longitudinal sense, wedge-shaped, etc., provided, however, that they form a sharp edge where they join the walls 45. The reduction in thickness of the walls 45 permit the latter to function as oil scrapers without being subjected to undue wear as a result of their continuous frictional engagement with the slide members.

Figure 5:
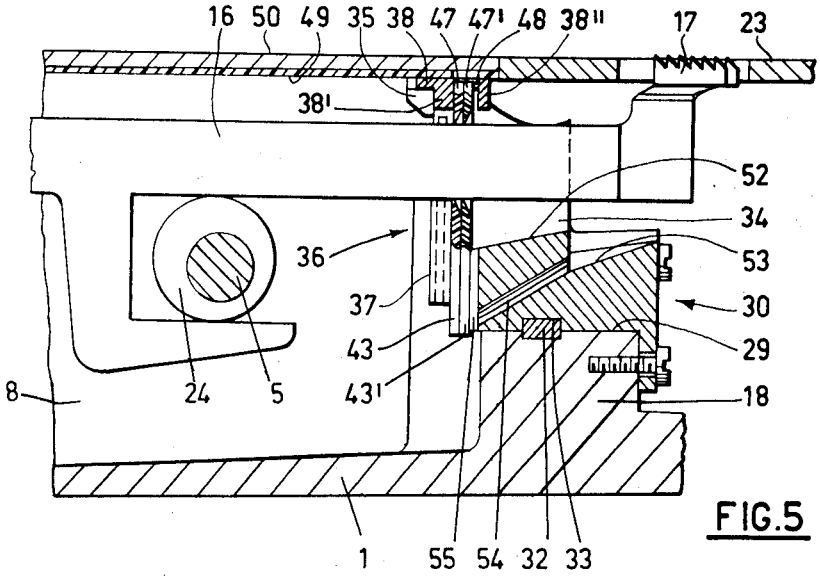
FIG. 5 is a sectional view as seen looking in the direction of the indicating arrows of Line V—V in FIG. 2.
Figure 6:
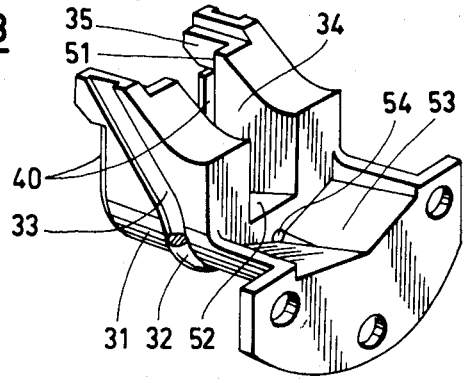
FIG. 6 is a perspective view and partially in section showing a modification of the sealing element shown in FIG. 3.
Figure 6:
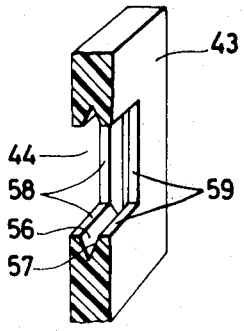
Figure 4:
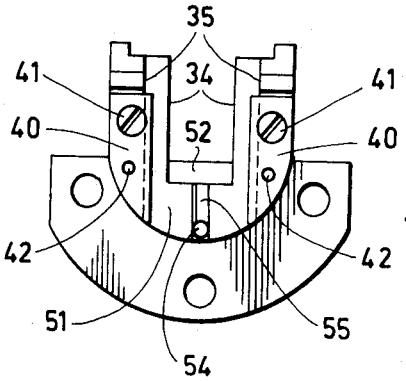
FIG. 4 is an end view as seen looking from the left of the support means in FIG. 3.

As can be seen in FIG. 5, the sealing elements 43 have been shown in cross-section to illustrate their relationship with the slide member 16 and the manner in which the walls 45 cooperate with said member to remove excess lubricant. The side of the sealing element 43 opposite the side having the inclined surfaces 46 is disposed so as to be directed toward the interior of the chamber 8 where it is subjected to the source of lubricant. The side of the sealing element 43 having the inclined surfaces 46 is directed outwardly of the chamber 8 and said inclined surfaces serve in directing the excess lubricant, removed from the slide member in a downwardly direction where it is returned to said chamber 8 in a manner yet to be described. To gain further benefit of the advantages of the sealing element 43, the recess 35 as shown in FIG. 5 has two such elements assembled in contiguous relation therein and with the second being identified by numeral 43'. The pair of sealing elements 43 and 43' shown in FIG. 5 are each facing in the same direction so that their inclined surfaces 46 are directed outwardly from the chamber 8; however, this arrangement can be altered for the effectiveness of the sealing device would not be changed if the inclined surfaces of sealing element 43' were reversed so that they were disposed face to face with the inclined surfaces of the sealing element 43. Irregardless of the arrangement of the sealing element 43 and 43', a pneumatic turbulence is created in the immediate area around the inclined surfaces 46 which serves in preventing a binding condition from occurring between the surfaces in contact as a result of absence of air. Actually, in this area the elasticity of the material permits the walls 45 to yield in the two directions of the alternating movements of the slide members so that the atmosphere present between the two sealing elements 43 and 43' is continuously being changed. The edges of walls 45 effect removal of the excess lubricant from the slide members during their alternating movements and said excess lubricant is caused to flow downwardly along the inclined surfaces away from the slide members. Referring now to FIG. 6 which shows a modification of the sealing element 43 and having an opening through which the slide members extend that is identified by numeral 44. The inclined surfaces of this sealing element are depicted by numerals 56 and 57 and define within the opening 44 a centrally disposed peripheral groove of V-shaped configuration which separates lubricant scraping walls 58 and 59. Like walls 45, these walls 58 and 59 are of reduced width relative to the thickness of the remainder of the sealing element. With a sealing element of this type having two oil scraping surfaces, it is only necessary to utilize one such element to gain the advantages described above that are provided when two sealing elements with single oil scraping surfaces are employed.

When one or more sealing elements 43 are assembled in the recess 35 of the support bracket 31, they are unaffected by the horizontal movement of the slides extending therethrough by being interposed between the spaced leg members 37 and an inner basewall 51 of said recess 35. As shown in FIG. 5, the upper ends of the sealing elements 43 and 43' are identified by numerals 47 and 47' respectively and they are also unaffected by the horizontal movement of the slide members by being located between a downwardly directed rib 38' formed intermediate the sides of the cross-piece 38 and a depending lip 38'' formed on the outer side of said cross-piece. This lip 38'' is located within the upper portion of the channel 34 so as to be in alignment with the basewall 51. Although the sealing elements 43 and 43' are prevented from moving horizontally with the slide members, they are caused to move vertically with the alternate vertical movements of the latter. This is made possible due to the fact that the lower portion of the recess 35 communicates with the chamber 8, there is sufficient clearance between the leg members 37 and the basewall 51 to permit vertical sliding movement of the sealing members and to prevent an interference with the upper ends of the latter, the cross-piece 38 is provided with a transverse slot 48 into which said ends can be moved. The fact that the upper ends 47 and 47' of the sealing element can enter the slot 48 during their vertical movement provides a further advantage of preventing escape of lubricant from the upper portion of the sealing device 30. Additional freedom of vertical movement for the upper end 47 and 47' is provided by a second transverse slot formed in a sealing gasket 49 for a cover 50 that serves to enclosed the upper portion of the chamber 8. This second transverse slot is located immediately above and in alignment with the transverse slot 48.

The sealing element 43 is readily replaceable when desired and can be accomplished without removing the slide members which if necessary, would entail a considerable amount of sewing machine down time. Removal of the sealing element is accomplished by first removing the cover 50, then pulling the support member 36 upwardly and out of the recess 35, and thence sliding the support bracket 31 forwardly which will then permit said sealing element to be slid forwardly and removed from the slide member. The support bracket 31 has other featured which for the purpose of this invention are of secondary importance, but which provide desirable advantages when considered from the point of view of efficient operation of the sealing device.

A particular advantage is that the lower surface 52 of the channel 34 is slanted downwardly in the direction of the chamber 8 (FIG. 5) and by means of a vertical channel 55 interconnecting the latter with said lower surface, a means is provided for returning the excess lubricant which accumulates in said channel 34 to said chamber 8. Additionally, the support bracket 31 is provided with a hopper-shaped recess 53 whichd is disposed forwardly of an immediately adjacent to the channel 34. Like the lower surface 52, the lower surface of recess 53 is also slanted downwardly in the direction of the chamber 8 and by means of a drilled passageway 54 interconnecting the lower surface of recess 53 with the lower end of the vertical channel 55, a means is provided for returning excess lubricant that may accumulate beyond the channel 34 to the chamber 8. As shown in FIG. 5, the passageway 54 communicates with the chamber 8 by means of the vertical channel 55 which is formed in the basewall 51 of the recess 35.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. A lubricant sealing device for the slide members which actuate the feed dogs in a sewing machine of the type having a housing with a lubricating chamber containing driving elements for the slide members and from which the latter extend to support the feed dogs in the machine's sewing zone, said sealing device comprising:

(a) a support bracket (31) mounted in the housing having an inner end communicating with the lubricating chamber and extending from the latter in the direction of the sewing zone, which includes:

(i) a channel (34) through which the slide members extend and guided for alternating vertical and horizontal movement by the driving elements; and (ii) means defining a recess (35) extending from said channel (34) to said inner end;

(b) a sealing element (43) having lubricant scraping surfaces formed by spaced walls defining an opening (44) of a size conforming to the cross sectional configuration of the slide members and through which the latter extend;

(c) means for mounting said sealing element in said recess (35) for sliding movement restricted to the alternate vertical movement of the slide members; and (d) means operatively associated with said channel (34) for receiving excess lubricant removed from the slide members by said spaced walls and returning the same to the lubricating chamber.

2. The lubricant sealing device according to claim 1 wherein said sealing element is fabricated from a wear resistant resilient material.

3. The lubricant sealing device according to claim 2 wherein said sealing element includes inclined surface (46) interconnecting walls (45) with the remainder of said element forming surfaces for directing excess lubricant removed from the slide members to said receiving means.

4. The lubricant sealing device according to claim 3 wherein said walls (45) are of substantially reduced width relative to the remainder of said sealing element for effecting yielding movement thereof with the alternate horizontal movements of the slide members.

5. The lubricant sealing device according to claim 2 wherein said sealing element includes diverging inclined surfaces (56,57) defining a centrally disposed peripheral groove within said opening 44 and aligned spaced walls (58,59) of substantially reduced width relative to the remainder of said sealing element for effecting yielding movement thereof with the alternate horizontal movements of the slide members.

6. The lubricant sealing device according to claim 1 wherein said means for mounting said sealing element (43) in said recess (35) defines a support member (36) including:

(a) a horizontal cross-piece (38);

(b) a pair of spaced leg members (37) depending from said cross-piece; and (c) means forming the outer opposed surfaces of said leg members for locating said support member (36) in said recess (35).

7. The lubricant sealing device according to claim 6 wherein said recess (35) includes a pair of spaced plate members (40) fixed therein and said locating means defines a longitudinally extendng groove (39) in each of said leg members into which the opposed sides of said plate members (40) extend.

8. The lubricant sealing device according to claim 6 wherein said cross-piece (38) includes means defining a transverse slot (48) for preventing restriction of movement of said sealing element during the laternate vertical movements of the slide members.

9. The lubricant sealing device according to claim 1 wherein said receiving means defines a lower surface (52) of said channel (34) slanted downwardly toward the lubricating chamber and a vertical channel 55 interconnecting the latter with said lower surface (52).

10. The lubricant sealing device according to claim 9 wherein said receiving means further includes a means defining a hopper-shaped recess (53) for receiving excess lubricant migrating beyond said lower surface (52) and a passageway (54) interconnecting said recess (53) with said vertical channel (55).

* * * * *

UNITED STATES PATENT AND TRADEMARK OFFICE

CERTIFICATE OF CORRECTION

PATENT NO. : 4,284,019

DATED : August 18, 1981

INVENTOR(S) : Franco Marchesi

It is certified that error appears in the above–identified patent and that said Letters Patent are hereby corrected as shown below:

Column 4, line 40, delete "Telfon" and insert --Teflon--.

Column 6, line 48, delete "whichd" and insert --which--.

Signed and Sealed this

*Twelfth* Day of *January 1982*

[SEAL]

*Attest:*

GERALD J. MOSSINGHOFF

*Attesting Officer*

*Commissioner of Patents and Trademarks*